US009119509B2

(12) United States Patent
Nakamura

(10) Patent No.: US 9,119,509 B2
(45) Date of Patent: Sep. 1, 2015

(54) HAND DRYER APPARATUS

(75) Inventor: Jun Nakamura, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 451 days.

(21) Appl. No.: 13/259,314

(22) PCT Filed: Mar. 27, 2009

(86) PCT No.: PCT/JP2009/056345

§ 371 (c)(1),
(2), (4) Date: Sep. 23, 2011

(87) PCT Pub. No.: WO2010/109661

PCT Pub. Date: Sep. 30, 2010

(65) Prior Publication Data

US 2012/0011739 A1 Jan. 19, 2012

(51) Int. Cl.
*F26B 21/00* (2006.01)
*A47K 10/48* (2006.01)

(52) U.S. Cl.
CPC ..... *A47K 10/48* (2013.01)

(58) Field of Classification Search
CPC ..... A47K 10/48; F26B 21/004; F26B 21/14; F26B 21/001; A01K 13/001; A47C 21/048; B01D 12/00; B29C 35/049
USPC ..... 34/523
See application file for complete search history.

(56) References Cited

U.S. PATENT DOCUMENTS 4,797,772 A * 1/1989 Kaplanis ..... 361/42
4,914,833 A * 4/1990 Pilolla et al. ..... 34/526
5,459,944 A 10/1995 Tatsutani et al.
6,769,197 B1 8/2004 Tai (Continued)

FOREIGN PATENT DOCUMENTS

JP 3-66338 A 3/1991
JP 03066338 A * 3/1991

(Continued)

OTHER PUBLICATIONS

International Search Report (PCT/ISA/210) issued on Jul. 7, 2009, by Japanese Patent Office as the International Searching Authority for International Application No. PCT/JP2009/056345.

(Continued)

*Primary Examiner* — Kenneth Rinehart
*Assistant Examiner* — Bao D Nguyen
(74) *Attorney, Agent, or Firm* — Buchanan Ingersoll & Rooney PC

(57) ABSTRACT

A hand dryer apparatus includes a high-pressure airflow generator that generates a high pressure airflow, a control circuit that controls the high-pressure airflow generator, a power connecting unit that connects a commercial power source to the control circuit, a main body that forms a hull by housing the high-pressure airflow generator, the control circuit, and the power connecting unit, and nozzles that are formed in the main body and blows out the high pressure airflow created by the high-pressure airflow generator; further includes a panel composing a part of the main body and is detachable by a tool, and switching units that are housed in the main body and can switch a setting of the hand dryer apparatus, and enables access to the power connecting unit and the switching unit by removing the panel.

10 Claims, 3 Drawing Sheets

(56) References Cited

U.S. PATENT DOCUMENTS

| | | | | |
|---|---|---|---|---|
| 2007/0079524 | A1 | 4/2007 | Sato et al. | |
| 2007/0263994 | A1 | 11/2007 | Diez et al. | |
| 2008/0209760 | A1 | 9/2008 | French et al. | |
| 2008/0216343 | A1 | 9/2008 | Churchill et al. | |
| 2008/0216344 | A1 | 9/2008 | Churchill et al. | |
| 2008/0222910 | A1 | 9/2008 | Churchill et al. | |
| 2008/0253754 | A1 * | 10/2008 | Rubin | 392/381 |

FOREIGN PATENT DOCUMENTS

| | | | | |
|---|---|---|---|---|
| JP | 6-209879 | A | | 8/1994 |
| JP | 11-18999 | A | | 1/1999 |
| JP | 2000-93347 | A | | 4/2000 |
| JP | 2002-034846 | A | | 2/2002 |
| JP | 2002034846 | A | * | 2/2002 |
| JP | 2006-187308 | A | | 7/2006 |
| JP | 2006187308 | A | * | 7/2006 |
| JP | 2007-289387 | A | | 11/2007 |

OTHER PUBLICATIONS

Written Opinion (PCT/ISA/237) issued on Jul. 7, 2009, by Japanese Patent Office as the International Searching Authority for International Application No. PCT/JP2009/056345.

European Communication and Supplementary European Search Report dated Dec. 5, 2014 issued in the corresponding European Patent Application No. 09842275.1-1601 (6 pages).

* cited by examiner

HAND DRYER APPARATUS

TECHNICAL FIELD

The present invention relates to a hand dryer apparatus, and particularly relates to a hand dryer apparatus that dries a hand by blowing off water drops attached on the hand with a high pressure airflow.

BACKGROUND ART

Conventionally, as an apparatus that dries a wet hand after washed, there is a hand dryer apparatus that dries a hand by blowing off and dries water drops attached on a hand with a fast airflow. The apparatus includes switching units that switch airflow by changing output of a high-pressure airflow generator, switch ON/OFF of a heater for producing warm air from a high pressure airflow, and switch ON/OFF of a main power to the hand dryer apparatus. The switching units are operated by an administrator of the hand dryer apparatus, and settings are switched in accordance with an installation environment. For example, according to a Patent Document 1, considering operationality, a switching unit is provided on the upper part, or on a lateral side, of the hand dryer apparatus. However, the switching unit of the apparatus disclosed in the Patent Document 1 can be operated without permission by the administrator of the hand dryer apparatus, or operated with mischievous intention. Therefore, a Patent Document 2 discloses a technology by which a switching unit is provided on a place difficult to be recognized by any person other than the administrator.

Patent Document 1: Japanese Patent Application Laid-open No. 2002-34846

Patent Document 2: Japanese Patent Application Laid-open No. 2006-187308

DISCLOSURE OF INVENTION

Problem to be Solved by the Invention

However, according to the apparatus disclosed in the Patent Document 2, a switching unit is shielded by a shielding unit that can be easily removed when cleaning the hand dryer apparatus. In this case, even though the switching unit is difficult to be seen from a user of the hand dryer apparatus, the shielding unit can be removed without any tool, so that it is not secure in terms of tamper-proof shielding. Moreover, if various settings are once set when installing the hand dryer apparatus, the necessity of switching the settings is unlikely to arise in the hand dryer apparatus afterward, and thus, it is inefficient to shield the switching unit by the shielding unit that is removed at every cleaning time.

The present invention has been made to solve the above problem, and an object of the present invention is to obtain a hand dryer apparatus that can be easy for an administrator of the hand dryer apparatus to switch settings, but difficult for a general user to switch the settings.

Means for Solving Problem

In order to solve the aforementioned problems and attain the aforementioned object, a hand dryer apparatus according to one aspect of the present invention is constructed in such a manner as to include a high-pressure airflow generator that generates a high pressure airflow, a control circuit that controls the high-pressure airflow generator, a power connecting unit that connects a commercial power source to the control circuit, a main body that forms a hull by housing the high-pressure airflow generator, the control circuit, and the power connecting unit, and nozzles that are formed in the main body and blows out the high pressure airflow created by the high-pressure airflow generator, the hand dryer apparatus further include: a panel composing a part of the main body, and is detachable by using a tool; and a switching unit that is housed in the main body, and can switch a setting of the hand dryer apparatus, wherein access to the power connecting unit and the switching unit is available by removing the panel.

Effect of the Invention

According to the present invention, a hand dryer apparatus of which settings are easy to switch for an administrator of the hand dryer apparatus, but are difficult for a general user to switch can be obtained.

EXPLANATIONS OF LETTERS OR NUMERALS

Figure 1:
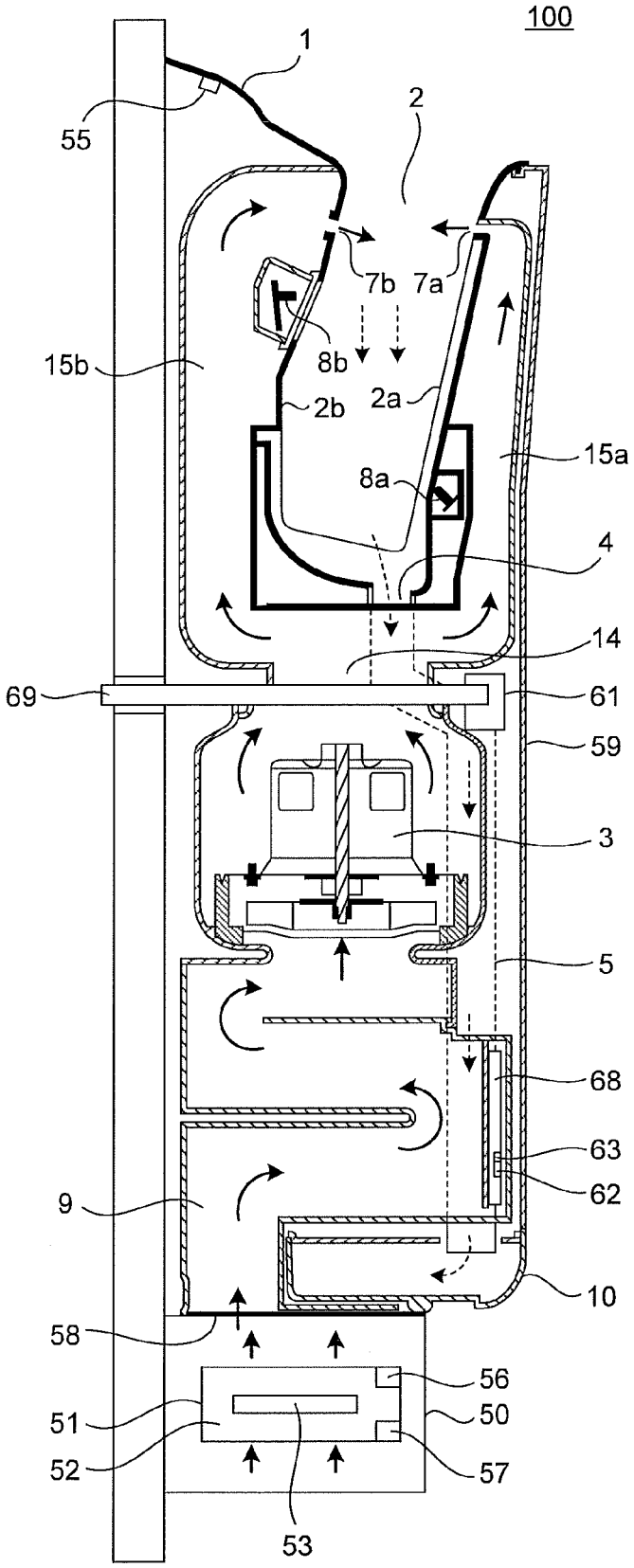
FIG. 1 is a cross-sectional view of a hand dryer apparatus according to an embodiment of the present invention when looking at the hand dryer apparatus from a lateral direction.

1 Main body box (main body)
2 Hand insertion unit
2*a* Inner wall surface (front side)
2*b* Inner wall surface (back side)
3 Blower (high-pressure airflow generator)
4 Drain outlet
5 Drain pipe
7*a* First nozzle
7*b* Second nozzle
8*a* First hand-detection sensor
8*b* Second hand-detection sensor
9 Inlet duct
9*a* Air inlet
10 Drain container
14 Exhaust vent
15*a*, 15*b* Exhaust duct
20 Air filter
50 Heater unit
51 Thermal storage heater (heating unit)
52 Aluminum die casting
53 Sheathed heater
54 Control circuit
55 Room temperature thermistor
56 Heater thermistor
57 Heater thermostat
58 Connecting unit
59 Front panel (panel)
60*a*, 60*b* Screw
61 Terminal base
62 DIP switch (switching unit)
63 DIP switch (switching unit)
64 Protective cover
65 Protective cover
66 Screw
67 Screw
68 Substrate
69 Indoor wiring
100 Hand dryer apparatus

BEST MODE(S) FOR CARRYING OUT THE INVENTION

An embodiment of a hand dryer apparatus according to the present invention is explained below in detail with reference to the drawings. However, the present invention is not limited by the embodiment.

Embodiment

Figure 2:
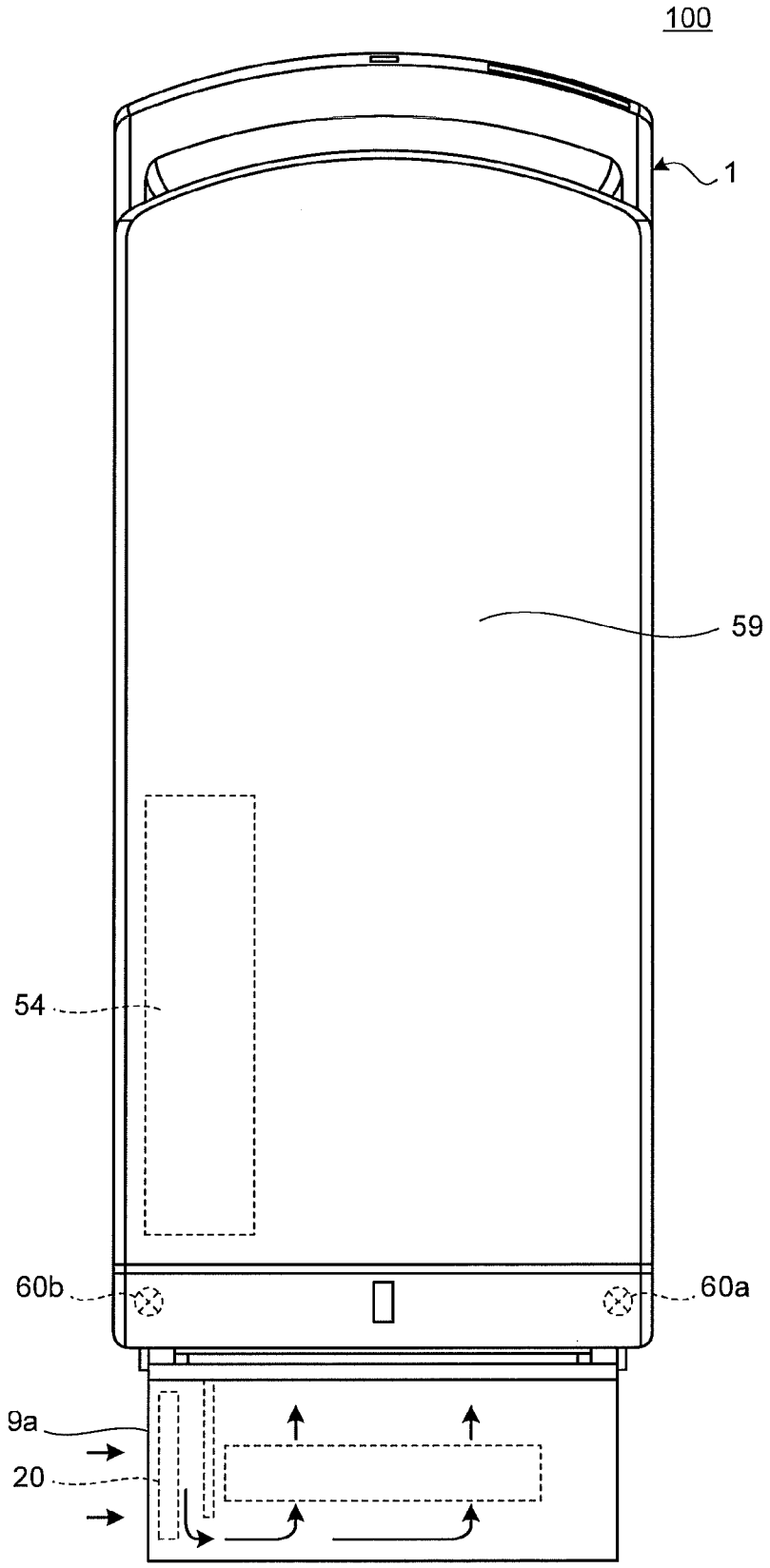
FIG. 2 is a front view of the hand dryer apparatus.

FIG. 1 is a cross-sectional view of a hand dryer apparatus according to an embodiment of the present invention when observed from a lateral direction. FIG. 2 is a front view of the hand dryer apparatus. In FIG. 1, arrows expressed by solid lines indicate flows of airflows, and arrows expressed by broken lines indicate flows of water drops removed from a hand. In FIG. 1, a main body box 1 (main body) composing a main body forms a hull of a hand dryer apparatus 100; and the upper side and lateral sides of the main body box 1 are provided with a hand insertion unit 2, which inclines downward, opens in a substantial U-shape, and allows a free insertion and/or removal of a hand. Moreover, a blower 3 as a high-pressure airflow generator is built in below the hand insertion unit 2 of the main body box 1.

A drain outlet 4 is formed on the bottom of the hand insertion unit 2; the drain outlet 4 is connected to a drain pipe 5; and the drain pipe 5 extends to a drain container 10 that is arranged in the lower part of the main body box 1. Water drops and water removed from a hand is called drainage. Inner wall surfaces 2*a* and 2*b*, which are opposite surfaces of the hand insertion unit 2, are coated with a water repellent coating containing silicon, fluorine or the like, or a hydrophilic coating, such as titanium oxide; and further, the coating is impregnated with an antibacterial agent, and so as to reduce deposition of contamination onto the inner wall surfaces 2*a* and 2*b* and to reduce propagation of bacteria.

The inner wall surfaces 2*a* and 2*b* in the vicinity of a mouth of the hand insertion unit 2 are provided with first and second nozzles 7*a* and 7*b* that blow out a high pressure airflow generated by the blower 3; the first and the second nozzles 7*a* and 7*b* blow airflows onto both of the back and the palm of a hand; and slopes forming a pressure gradient from the mouth to the back are included so that water drops attached on hands can be removed from the both sides of the hands without rubbing the hands inserted into the hand insertion unit 2. Moreover, a first hand-detection sensor 8*a* for detecting insertion of a hand is provided in a lower part of the front-side surface of the hand insertion unit 2; and a second hand-detection sensor 8*b* is provided in a substantial center part of the back-side surface.

A heater unit 50 is provided under the main body box 1, and provided with a thermal storage heater 51 in its inside. The thermal storage heater 51 includes a sheathed heater 53 as a heating element inside an aluminum die casting 52 as a thermal storage material. A room temperature thermistor 55 that measures the room temperature of a room in which the hand dryer apparatus 100 is installed placed, and a heater thermistor 56 that measures the temperature of the aluminum die casting 52 are connected to a control circuit 54 (FIG. 2). The control circuit 54 controls the passage of electric current to the sheathed heater 53 in accordance with a room temperature such that the temperature of the aluminum die casting 52 becomes a temperature preliminarily stored by the control circuit 54. Furthermore, a heater thermostat 57 is mounted on the aluminum die casting 52 in series to a power supply line to the heater, as a provision for a failure in the control circuit 54 under a state where the passage of electric current to the sheathed heater 53 is ON. The heater thermostat 57 can keep the aluminum die casting 52 at a constant temperature by repeating the following operation: opening upon detecting 200° C., stopping the passage of electric current to the heater, then closing again when being cooled down to 150° C., and starting the passage of electric current to the heater. It is needless to say that when the control circuit 54 is in normal operation, the temperature of the aluminum die casting 52 is controlled by the control circuit 54 so as not to reach 200° C.

A lower part of the main body box 1 is provided with an inlet duct 9. The inlet duct 9 extends downward by meandering from the blower 3 provided in a substantial center part of the main body box 1, passes through the back of the drain container 10, reaches a connecting unit 58 with the heater unit 50, further passes around the thermal storage heater 51 inside the heater unit 50, which is a chamber structure, and then opens to an air inlet 9*a* (FIG. 2) on a lateral side of the heater unit 50. An air filter 20 (FIG. 2) is then mounted on the air inlet 9*a*. The upper part of the blower 3 is provided with an exhaust vent 14 that is further connected to the inlet duct 9, and is communicated with the first and the second exhaust ducts 15*a* and 15*b*, thereby to blow out air from the first and second nozzles 7*a* and 7*b*

Operation of the hand dryer apparatus 100 that is configured as described above is explained below. When a wet hand after washed is inserted into the hand insertion unit 2 of the hand dryer apparatus 100 up to the vicinity of its wrist, the first and the second hand-detection sensors 8*a* and 8*b* provided in the hand insertion unit 2 detect the insertion of the hand, and activate the blower 3. When the blower 3 is activated, air flows in from the air inlet 9*a* through the air filter 20, and after receiving heat from the thermal storage heater 51, the air is sent through the inlet duct 9 to the blower 3, and compressed. To reduce progress of cooling of the thermal storage heater 51, the control circuit 54 constantly passes an electric current to the sheathed heater 53 during the operation of the blower 3. However, if a current value when simultaneously operating the blower 3 and the sheathed heater 53 becomes too large, and an increase in the capacity of a commercial power source connected to the hand dryer apparatus 100 is required, it is acceptable to employ the control circuit 54 that is configured not to pass electric current to the sheathed heater 53 while the blower 3 is in operation.

The air having passed through the blower 3 turns to a high pressure airflow, passes from the exhaust vent 14 through the first and the second exhaust ducts 15*a* and 15*b*, and blows out from the first and the second nozzles 7*a* and 7*b* into the hand insertion unit 2. The high pressure airflows blown out from the first and the second nozzles 7*a* and 7*b* hit the hand inserted into the hand insertion unit 2, and blow off water attached on the surface of the hand as water drops. By further inserting and removing the hand into and from the hand insertion unit 2, substantially all of the water drops attached on the whole hand are removed, so that the hand is dried. The high pressure airflow is warmed so as to make a user feel comfortable by the thermal storage heater 51 that has stored heat to an appropriate temperature in accordance with a room temperature.

When the hand is removed from the hand insertion unit 2, the first and the second hand-detection sensors 8*a* and 8*b* detect the removal, and the blower 3 stops. The water drops removed from the wet hand hit the hand insertion unit 2, flow along the inner wall surfaces 2*a* and 2*b*, pass through the drain outlet 4 and the drain pipe 5 that are provided at the bottom of the hand insertion unit 2, and are collected into the drain container 10. Moreover, also after the blower 3 stops, the control circuit 54 controls the passage of electric current to the sheathed heater 53 in accordance with a room temperature such that the temperature of the aluminum die casting 52 becomes a preliminarily stored temperature.

The drain container 10 is detachable by drawing it forward; and screws 60*a* and 60*b* that fix a front panel 59 composing a part of the hull of the hand dryer apparatus 100 are provided on the back of the drain container. The upper edge of the front panel 59 is hooked on the main body box 1 with a claw structure, so that the front panel 59 can be removed by removing the screws 60*a* and 60*b*. To remove the screws 60*a* and 60*b*, a tool, such as a driver, is required. A screw that cannot be removed without a dedicated tool can be used.

Figure 3:
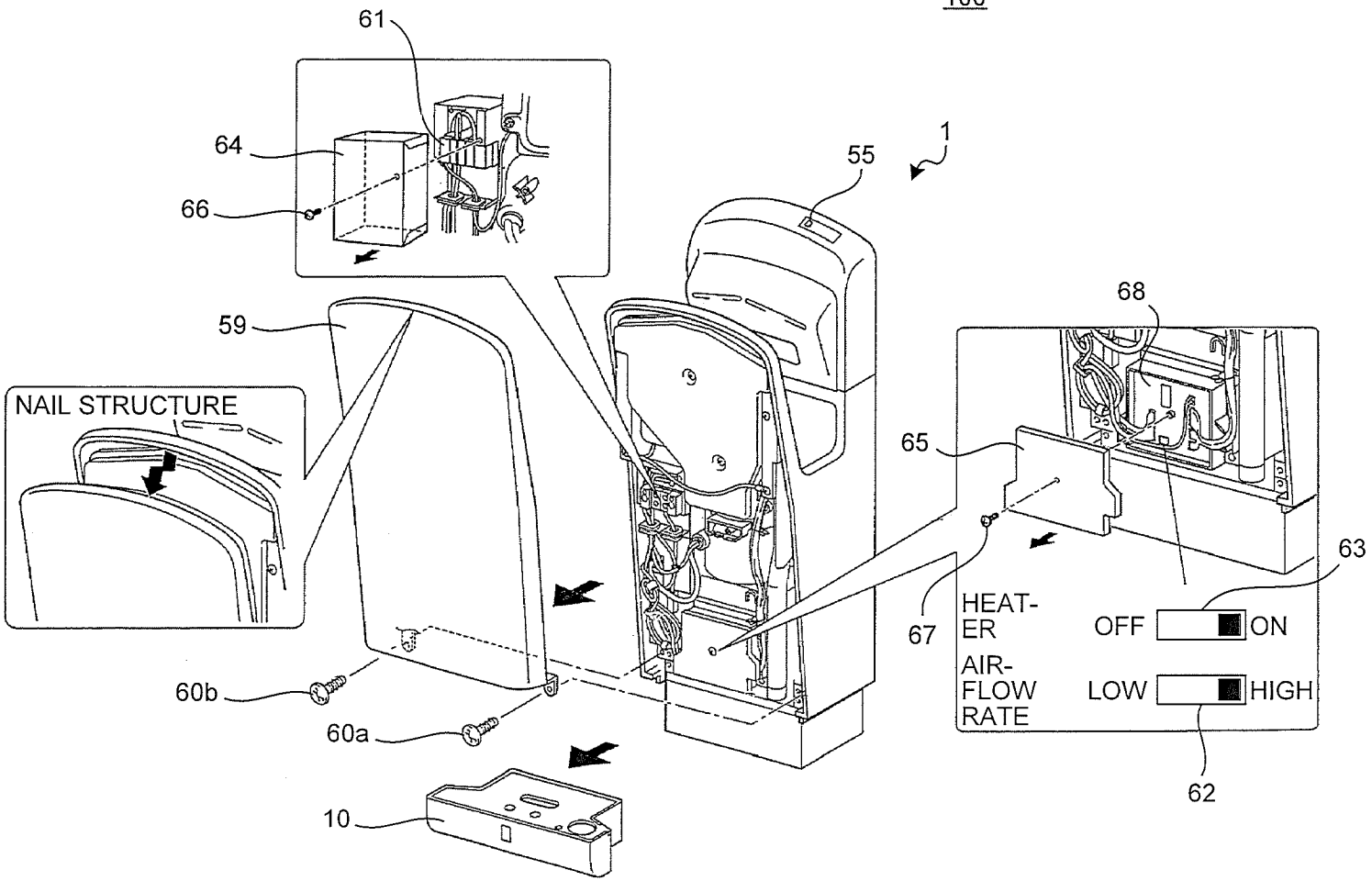
FIG. 3 is a perspective view and partial enlarged views of the hand dryer apparatus of which front panel is removed.

FIG. 3 is a perspective view and partially enlarged views of the hand dryer apparatus 100 with the front panel (panel) 59 being removed. By removing the front panel 59, a user can access to a terminal base 61 for connecting to a commercial power source, a DIP switch (switching unit) 62 that can switch settings of the blower 3, and a DIP switch (switching unit) 63 that switches ON/OFF of the power to the thermal storage heater 51.

The DIP switch 62 is for switching the strength of airflow of the blower 3 in operation. The DIP switch 63 is for switching ON/OFF of the power to the thermal storage heater 51. By operating the DIP switches 62 and 63, the administrator can select the strength of airflow and ON/OFF of the power to the thermal storage heater 51, thereby to achieve power savings. For example, when the hand dryer apparatus 100 is installed in a relatively warm climate district, a user unlikely feels uncomfortable even if the thermal storage heater 51 does not warm the air. Therefore, power saving can be achieved by turning off the power to the thermal storage heater 51.

According to the embodiment, the terminal base 61, and the DIP switches 62 and 63 are covered with protective covers 64 and 65. The protective covers 64 and 65 are provided on an inner side of the front panel 59, i.e., inside the main body. The protective covers 64 and 65 are removable by unscrewing screws 66 and 67, respectively. By removing the protective covers 64 and 65, a user can access the terminal base 61 and the DIP switches 62 and 63. To remove the screws 66 and 67, a tool, such as a driver, is needed. A substrate 68 on which the DIP switches 62 and 63 are arranged is insulated from the commercial power source by an isolation transformer. Accordingly, a risk of an electric shock when operating the DIP switches 62 and 63 can be reduced.

The front panel 59 is provided with waterproof processing on a juncture between the front panel 59 and the main body box 1 in order to protect electric parts, such as the blower 3 and the control circuit 54 arranged inside the main body, from water immersion; so that the inside of the front panel 59 is not to be immersed in water, and no additional waterproof processing dedicated for the DIP switches 62 and 63 is required.

As described above, when installing the hand dryer apparatus 100, by removing the front panel 59 and the covers 64 and 65, connection of an indoor wiring 69 of the commercial power source to the terminal base 61, and settings of output power of the blower 3 and ON/OF of the heater in accordance with a desire of the administrator of the hand dryer apparatus 100, can be carried out at once. Moreover, when the front panel 59 is returned after the installation is finished, the DIP switches 62 and 63 are covered with the front panel 59, so that it is difficult for a general user to change the above settings by mischievous intention. Moreover, to open the front panel 59, a dedicated tool, such as a driver, is needed, so that it is more difficult for a general user to change the settings.

Furthermore, because the front panel 59 and the protective cover 65 can be easily removed only by removing three of the screws 60*a*, 60*b* and 67 by using a driver or the like, the administrator of the hand dryer apparatus 100 can change the above settings even after the hand dryer apparatus 100 is mounted. Moreover, because the terminal base 61 is covered by the protective cover 64, and the DIP switches 62 and 63 and the substrate 68 are insulated, there is no risk of electric shock, and the settings can be safely changed.

Moreover, according to positional relation between the screws 60*a* and 60*b* and the drain container 10, the screws 60*a* and 60*b* are covered with a part of the drain container 10, it is made difficult to recognize visually the screws 60*a* and 60*b* in a mounted state of the hand dryer apparatus 100. Accordingly, it makes difficult for a general user to open the front panel 59, so that it makes more unlikely to brew mischief against the DIP switches 62 and 63.

According to the embodiment, as switchable settings of the hand dryer apparatus 100, an airflow rate of the blower 3 and ON/OFF of the heater are described as examples, the settings are not limited to these settings. For example, a main power switch (switching unit) for switching ON/OFF of a main power to the hand dryer apparatus 100 can be provided on the substrate 68. The main power switch means a switch that shuts down power supply to major devices of the hand dryer apparatus 100, such as the blower 3, and halts functions of the hand dryer apparatus 100. By providing the main power switch, when the hand dryer apparatus 100 is not used for a long time period, power saving can be achieved by turning off the main power. Moreover, by providing the main power switch on the substrate 68, while avoiding any setting change by mischief, the administrator can change settings.

Furthermore, the hand dryer apparatus can be configured not to provide the protective cover 65 that covers the DIP switched 62 and 63. In such a case, although the protective performance against change of settings by mischievous intention is slightly decreased, however, change of settings after the hand dryer apparatus 100 is installed becomes easier, thereby improvement of convenience for the administrator.

INDUSTRIAL APPLICABILITY

As described above, the hand dryer apparatus according to the present invention is useful for a hand dryer apparatus to be installed in a toilet, a lavatory, and the like; and particularly, suitable to be installed in a toilet, a lavatory, and the like, that have a possibility in use by general public people, for example, in office buildings, hotels, family restaurants, amusement facilities, general supermarkets, factories of foods, medical products, cosmetics, and other products, schools, public facilities, and the like.

The invention claimed is:

1. A hand dryer apparatus that includes a high-pressure airflow generator that generates a high pressure airflow, a control circuit that controls the high-pressure airflow generator, a power connecting unit that connects a commercial power source to the control circuit, a main body that forms a hull by housing the high-pressure airflow generator, the control circuit, and the power connecting unit, and nozzles that are formed in the main body and blow out the high pressure airflow created by the high-pressure airflow generator, the hand dryer apparatus further comprising:

a panel composing a part of the main body, the panel having an inside surface that face towards inside the hand dryer apparatus and an outside surface that faces in an opposite direction from the inside surface, a switching unit that is housed in the main body, and is configured to switch a setting of the hand dryer apparatus, and a drain container that is provided in a manner detachable from the main body, and collects water drops blown off by the high pressure airflow, wherein the panel is fixed to the main body by a screw provided on the outside surface of the panel, and is detachable from the main body by using a tool that engages the screw, the panel covers the power connecting unit and the switching unit when the panel is fixed to the main body and allows access to the power connecting unit and the switching unit when the panel is removed, the drain container covers a part of the panel where the screw fixes the panel to the main body and hides the screw from being viewed outside of the hand dryer apparatus, and the panel is configured such that the screw is inserted into the outside surface of the panel in a direction parallel to a direction in which the drain container is detached from the main body.

2. The hand dryer apparatus according to claim 1, wherein the switching unit can switch strength of airflow of the high pressure airflow.

3. The hand dryer apparatus according to claim 1, further comprising a heating unit that warms the high pressure airflow, wherein the switching unit can switch ON/OFF of a power to the heating unit.

4. The hand dryer apparatus according to claim 1, wherein the switching unit can switch ON/OFF of a main power of the hand dryer apparatus.

5. The hand dryer apparatus according to claim 1, wherein the switching unit is insulated from a commercial power source by an isolation transformer.

6. The hand dryer apparatus according to claim 1, further comprising a protective cover that is provided inside the main body, covers the switching unit, and is detachable.

7. The hand dryer apparatus according to claim 1, wherein the screw requires a dedicated driver as the tool.

8. The hand dryer apparatus according to claim 1, wherein the drain container is a letter T shape.

9. The hand dryer apparatus according to claim 8, wherein an upper part of the letter T hides the screw.

10. The hand dryer apparatus according to claim 1, wherein the panel has a main plane and a tab that extends parallel to the main plane, and the screw is inserted through the tab.

* * * * *